US006814311B2

(12) United States Patent
Kobayashi et al.

(10) Patent No.: US 6,814,311 B2
(45) Date of Patent: Nov. 9, 2004

(54) FUEL INJECTION VALVE

(75) Inventors: Nobuaki Kobayashi, Gunma (JP); Yuichi Uchiyama, Gunma (JP); Hideo Kato, Tochigi (JP); Hiroshi Okada, Gunma (JP)

(73) Assignee: Unisia Jecs Corporation, Kanagawa (JP)

( * ) Notice: Subject to any disclaimer, the term of this patent is extended or adjusted under 35 U.S.C. 154(b) by 199 days.

(21) Appl. No.: 10/093,402

(22) Filed: Mar. 11, 2002

(65) Prior Publication Data

US 2002/0185555 A1 Dec. 12, 2002

(30) Foreign Application Priority Data

May 30, 2001 (JP) ..... 2001-163414
May 31, 2001 (JP) ..... 2001-165518

(51) Int. Cl.[7] ..... B05B 1/30; F02M 59/00; F02M 47/02

(52) U.S. Cl. ..... 239/585.1; 239/585.5; 239/533.2; 239/533.3; 239/88

(58) Field of Search ..... 239/88, 89, 90, 239/91, 533.2, 533.3, 533.11, 533.7, 533.8, 533.9, 585.1, 585.2, 585.3, 585.4, 585.5; 251/129.15, 129.21, 127

(56) References Cited

U.S. PATENT DOCUMENTS 4,934,605 A * 6/1990 Hans et al. ..... 239/585.4
5,091,024 A * 2/1992 DeBold et al. ..... 148/306
5,783,261 A * 7/1998 Potter et al. ..... 427/526
5,927,613 A * 7/1999 Koyanagi et al. ..... 239/585.1
6,062,499 A * 5/2000 Nakamura et al. ..... 239/585.1
2001/0002681 A1 6/2001 Willke et al.

FOREIGN PATENT DOCUMENTS

DE 19547406 A1 6/1997
JP 2000-8990 1/2000

* cited by examiner

*Primary Examiner*—Davis Hwu
(74) *Attorney, Agent, or Firm*—Sughrue Mion, PLLC

(57) ABSTRACT

A fuel injection valve for an internal combustion engine has a tubular metal case constructed of a magnetic material in and through which a fuel is to flow. The tubular metal case has one open end. A valve seat is tightly received in the open end of the tubular metal case. The valve seat has a fuel outlet formed therein. A valve element is axially movably received in the tubular metal case. The valve element is movable between a closed position wherein a valve body of the element closes the fuel outlet and an open position wherein the valve body opens the fuel outlet. An electromagnetic actuator is disposed about the tubular metal case to actuate the valve element to move between the closed and open positions. The tubular metal case is constructed of a ferritic stainless steel containing Titanium. An end portion of the tubular metal case to which a valve seat is fixed has a wall thickness which ranges from approximately 0.1 mm to 0.9 mm.

16 Claims, 15 Drawing Sheets

FUEL INJECTION VALVE

BACKGROUND OF THE INVENTION

1. Field of the Invention

The present invention relates to fuel injection valves connected to an automotive internal combustion engine for injecting fuel into combustion chambers of the engine. More specifically, the present invention is concerned with the fuel injection valves of a type which is compact in size, light in weight and easy to produce.

2. Description of Related Art

Hitherto, various types of fuel injection valves are proposed and put into practical use particularly in the field of automotive internal combustion engines. Some of them are shown in Laid-open Japanese Patent Application (Tokkai) 2000-08990 and Laid-open German Patent Application (DE) 19547406A1. The fuel injection valves of these references are of a type that generally comprises a tubular metal case, a valve element axially movably received in the metal case, a solenoid coil disposed about the metal case and a plastic cover applied on both the metal case and the solenoid coil by means of injection molding technique. However, in the fuel injection valves of this type, compactness and weight reduction have been difficult due to some reasons. One reason is a difficulty with which the thickness of wall of the tubular metal case is reduced. That is, if the thickness is simply reduced, the metal case fails to have a sufficient mechanical strength bearing a marked pressure applied thereto when the injection molding is applied thereto. The other reason is a complicated shape which the tubular metal case has. In fact, the metal case is constructed to have stepped portions. Thus, the fuel injection valves of the publications tend to have a bulky and heavier construction.

SUMMARY OF THE INVENTION

It is therefore an object of the present invention to provide a fuel injection valve which is compact in size, light in weight and easy to produce.

According to a first aspect of the present invention, there is provided a fuel injection valve which comprises a tubular metal case constructed of a magnetic material in and through which a fuel is to flow, the tubular metal case having one open end; a valve seat tightly received in the open end of the tubular metal case, the valve seat having a fuel outlet formed therein; a valve element axially movably received in the tubular metal case, the valve element being movable between a closed position wherein a valve body of the element closes the fuel outlet and an open position wherein the valve body opens the fuel outlet; and an electromagnetic actuator disposed about the tubular metal case to actuate the valve element to move between the closed and open positions, wherein the tubular metal case is constructed of a ferritic stainless steel containing Titanium.

According to a second aspect of the present invention, there is provided a fuel injection valve which comprises a tubular metal case constructed of a magnetic material in and through which a fuel is to flow, the tubular metal case including a first portion with one end, a second portion with the other end and a third portion extending between the first and third portions; a valve seat tightly received in the first portion of the metal case, the valve seat having a fuel outlet formed therein; a valve element axially movably received in the third portion of the metal case, the valve element being movable between a closed position wherein a valve body of the element closes the fuel outlet and an open position wherein the valve body opens the fuel outlet; an electromagnetic actuator disposed on and about the third portion of the metal case to actuate the valve element to move between the closed and open positions; a plastic cover applied mainly onto the second portion of the metal case through an injection molding, wherein the first portion of the metal case has a wall thickness which ranges from approximately 0.1 mm to 0.9 mm, the second portion of the metal case has a wall thickness which is greater than that of the first portion by at least approximately 0.1 mm, and the third portion of the metal case has the same wall thickness as one of the first and second portions.

Other objects and advantages of the present invention will become apparent from the following description when taken in conjunction with the accompanying drawings.

DETAILED DESCRIPTION OF THE EMBODIMENTS

Figure 1:
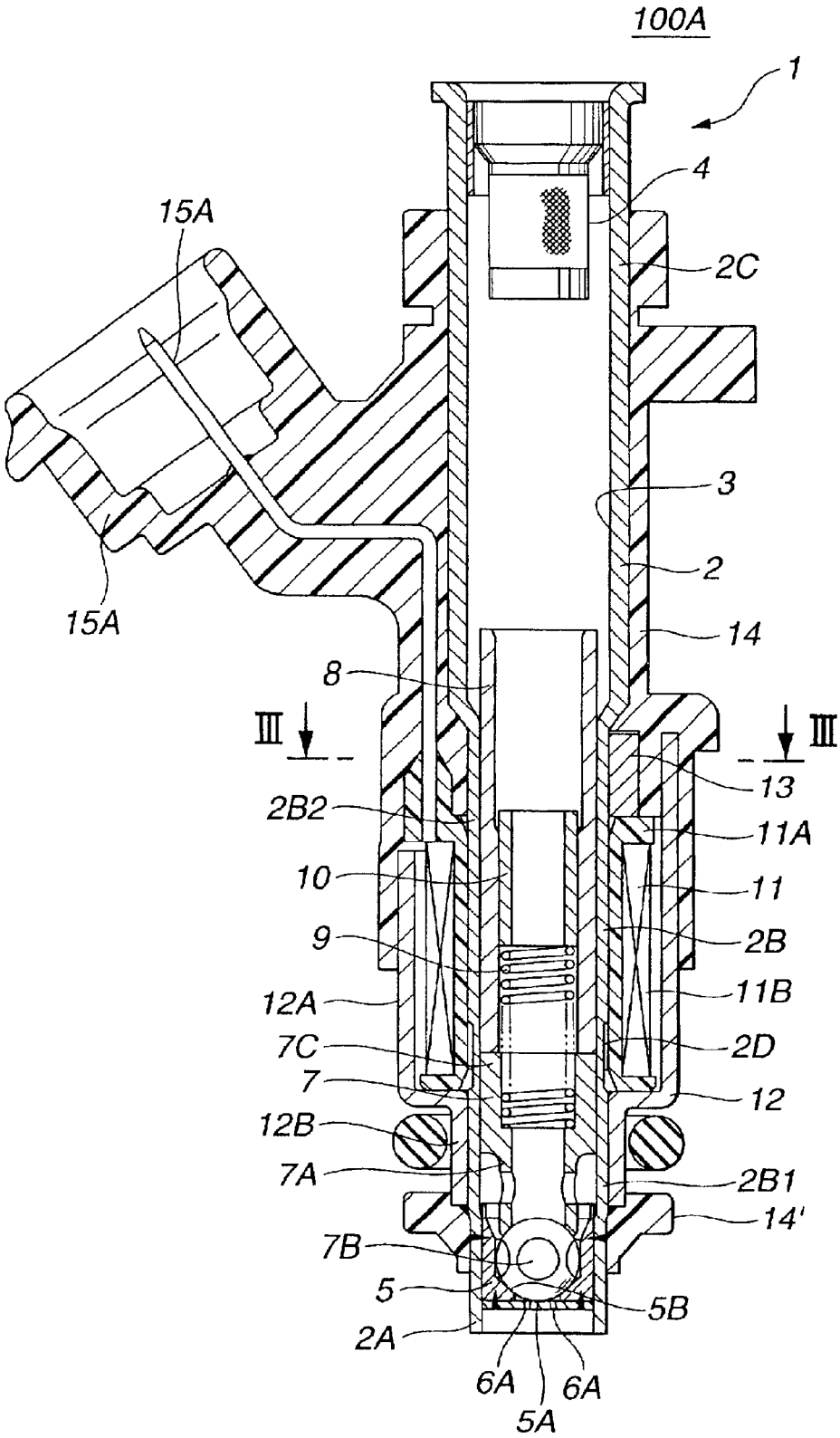
FIG. 1 is a longitudinally sectional view of a fuel injection valve which is a first embodiment of the present invention.

In the following, various embodiments of the present invention will be described in detail with reference to the accompanying drawings.

For ease of understanding, the following explanation may include various directional terms, such as, right, left, upper, lower, rightward, etc.,. However, these terms are to be understood with respect to only the drawing or drawings on which corresponding part or portion is illustrated. Furthermore, throughout the embodiments, substantially same parts and portions are denoted by the same numerals.

Referring to FIGS. 1 to 7, especially FIG. 1, there is shown a fuel injection valve of a first embodiment of the present invention, which is generally designated by numeral 100A.

The fuel injection valve 100A, like the other valves 100B, 100C and 100D which will be described hereinafter, is a valve that is constructed to be practically applicable to an internal combustion engine.

As is seen from FIG. 1, the fuel injection valve 100A has a valve casing unit 1 which includes a tubular metal case 2, a tubular metal cover 12 and a plastic cover 14.

The tubular metal case 2 is of a magnetic material such as a magnetic stainless steel or the like. As will be described hereinafter, the tubular metal case 2 may be constructed of a ferritic stainless steel including Titanium (Ti). For producing the metal case 2, various techniques such as deep drawing technique, cutting technique, grinding technique and the like can be used.

Figure 4:
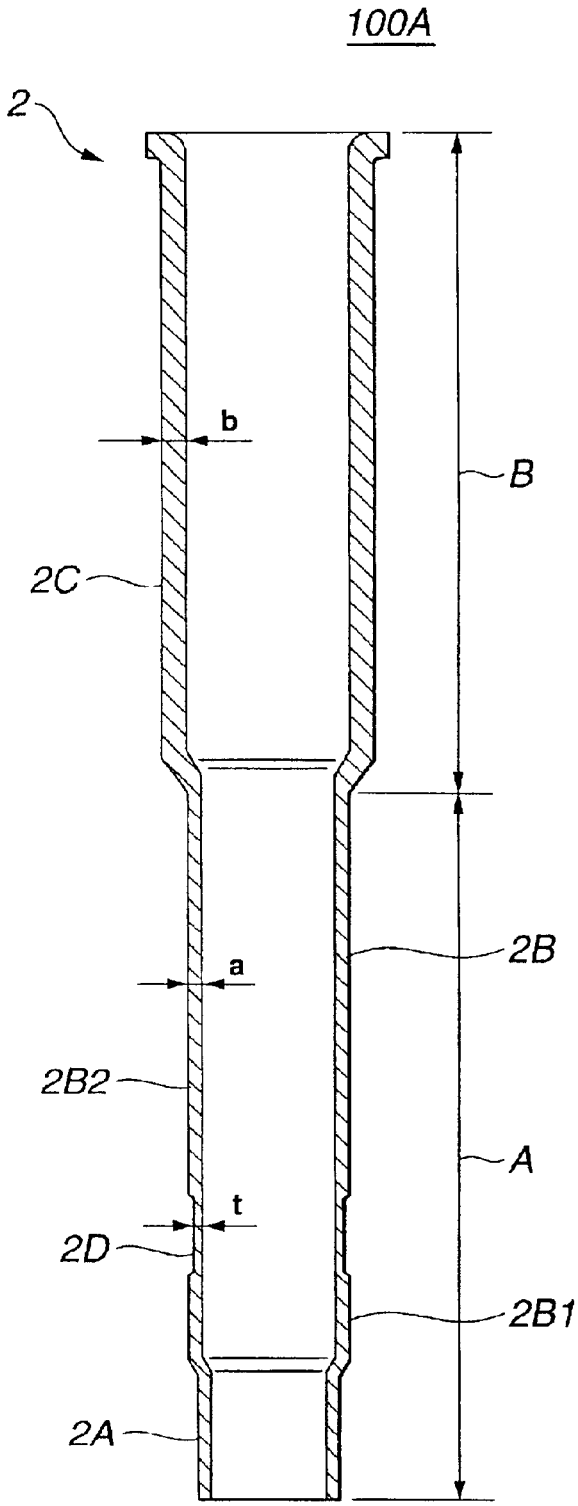
FIG. 4 is a longitudinally sectional view of a tubular metal case employed in the fuel injection valve of the first embodiment.

FIG. 4 shows the detail of the tubular metal case 2 produced through such techniques. As shown in this drawing, the metal case 2 is formed with stepped portions.

As is seen from FIG. 1, the tubular metal case 2 comprises generally a smaller diameter lower portion (or first portion) 2A to which an after-mentioned valve seat 5 is fixed, an intermediate portion (or third portion) 2B which has an after-mentioned electric coil 11 disposed thereon, and a larger diameter upper portion (or second portion) 2C which has a major portion of the plastic cover 14 disposed thereon.

As is seen from FIG. 4, the lower and intermediate portions 2A and 2B of the tubular metal case 2 have a wall thickness "a" of about 0.1 mm to 0.9 mm, preferably about 0.2 mm to 0.5 mm. The diameter of the lower portion 2A is smaller than that of the intermediate portion 2B. The intermediate portion 2B is formed near the lower portion 2A with an annular recess 2D whose bottom wall has a thickness "t" smaller than "a".

Figure 2:
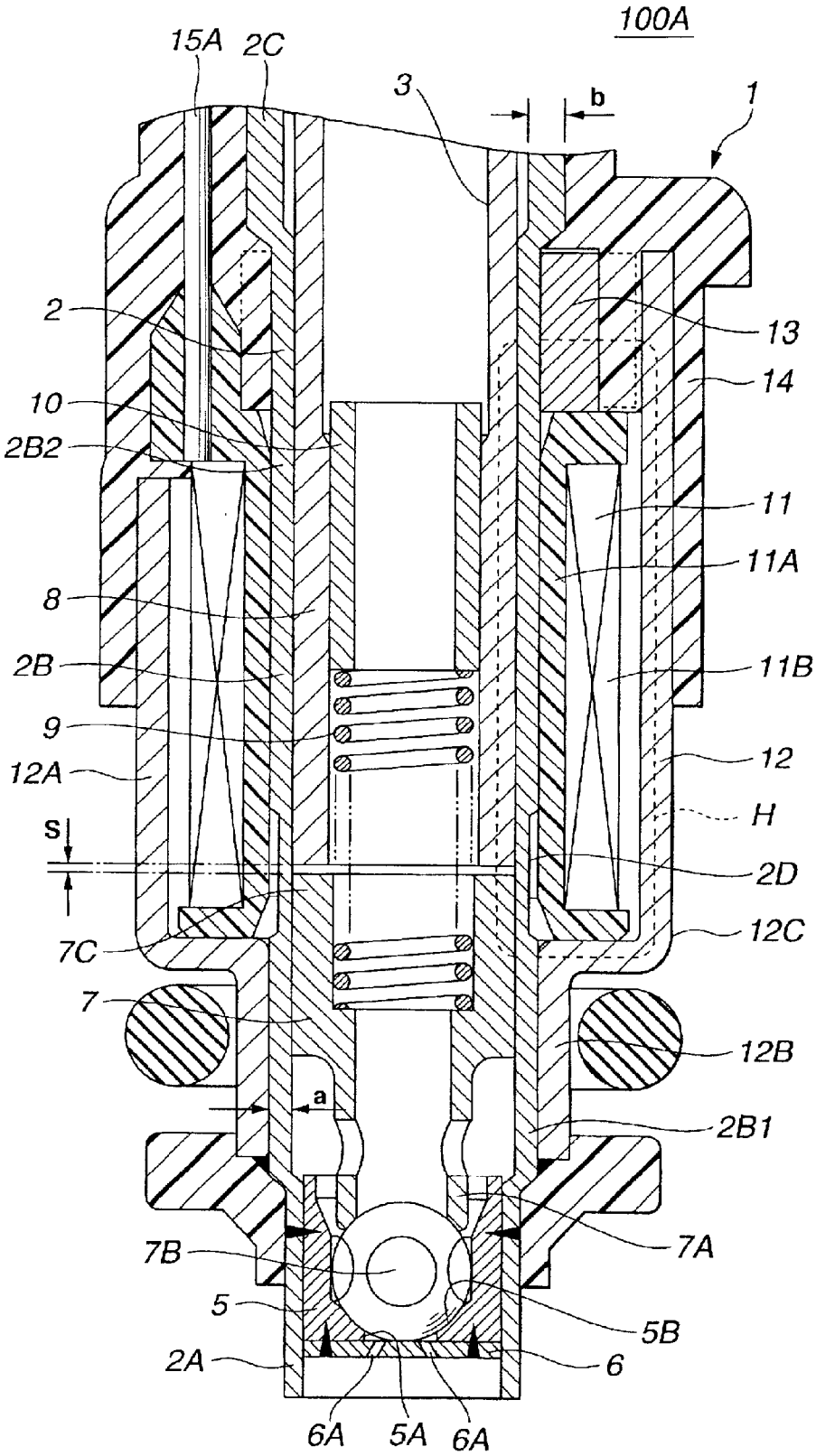
FIG. 2 is a longitudinally sectional enlarged view of a nozzle part of the fuel injection valve of the first embodiment.

As is seen from FIG. 2, upon assembly, the annular recess 2D is positioned to surround a given clearance "S" which is defined between mutually facing ends of after-mentioned valve element 7 and core tube 8. Accordingly, the intermediate portion 2B of the tubular metal case 2 has two portions, one being a valve element receiving portion 2B1 in which the valve element 7 is slidably received, and the other being a core tube receiving portion 2B2 in which the core tube 8 is tightly received. Due to provision of the annular recess 2D, a magnetic resistance between the two portions 2B1 and 2B2 is increased, which isolates these two portions 2B1 and 2B2 magnetically.

The larger diameter upper portion 2C of the tubular metal case 2 is sized larger than the intermediate portion 2B in diameter. Furthermore, as is seen from FIGS. 1 and 2, the wall thickness "b" of the upper portion 2C is larger than that "a" of the lower and intermediate portions 2A and 2B. With this increased thickness "b" of the wall, the upper portion 2C can bear the remarkable pressure applied thereto when a molten plastic is applied thereonto under an injection molding. As is understood from the following inequality, the thickness "b" is greater than "a" by at least 0.1 mm.

$$b \geqq a+0.1 \quad (1)$$

In view of the inequality (1), the thickness "b" of the wall of the larger diameter upper portion 2C is about 0.2 mm to 1.0 mm, preferably about 0.3 mm to 0.6 mm.

Accordingly, as is seen from FIG. 4, the tubular metal case 2 consists of two portions, one being a thinner wall portion "A" including the lower and intermediate portions 2A and 2B, and the other being a thicker wall portion "B" including the upper portion 2C.

Referring back to FIG. 1, within the tubular metal case 2, there is defined a fuel passage 3 which leads to the valve seat 5 fixed in the smaller diameter lower portion 2A of the case 2. Furthermore, a fuel filter 4 is fixed to an upper portion of the fuel passage 3 to filter a fuel flowing through the fuel passage 3.

As is best seen from FIG. 2, the valve seat 5 is shaped cylindrical and concentrically and tightly received in the lower portion 2A of the case 2. For the tight receiving, the valve seat 5 is welded to the lower portion 2A. The valve seat 5 is formed with a fuel outlet 5A which faces downward in the drawing, and a concave valve seating surface 5B which extends around the fuel outlet 5A. A nozzle plate 6 is secured to a bottom wall of the valve seat 5, which is formed with a plurality of injection nozzles 6A mated with the fuel outlet 5A of the valve seat 5.

As shown in FIG. 1, the valve element 7 is slidably received in the valve element receiving portion 2B1 of the tubular metal case 2. The valve element 7 is constructed of a magnetic metal and comprises a tubular valve stem 7A, a spherical valve body 7B fixed to a leading end of the valve stem 7A and hermetically contactable to the valve seating surface 5B of the valve seat 5 and a base portion 7C slidably received in the valve element receiving portion 2B1 and constituting a base of the valve stem 7A.

When the valve element 7 is in a closed position, the valve body 7B is hermetically seated on the valve seating surface 5B by the force of an after-mentioned biasing spring 9. Under this condition, an upper end surface faces a lower end surface of the core tube 8 keeping the given clearance "S" defined therebetween. While, when the electric coil 11 is energized to generate a magnetic field "H", the core tube 8 magnetically attracts the valve element 7, so that the valve element 7 is lifted up against the force of the biasing spring 9 from the valve seating surface 5B by a distance corresponding to the given clearance "S". With this lifting, the valve element 7 takes an open position opening the injection nozzles 6A.

The core tube 8 is of a magnetic metal and press-fitted in the core tube receiving portion 2B2 of the tubular metal case 2. The core tube 8 has a tubular spring holder 10 press-fitted therein.

The biasing spring 9 is compressed between the valve element 7 and the tubular spring holder 10, so that valve element 7 is constantly biased downward in FIG. 2, that is, in a direction to close the injection nozzles 6A.

As is best seen from FIG. 2, the electric coil 11 is arranged to put around the core tube receiving portion 2B2 of the tubular metal case 2. More specifically, the electric coil 11 is a unit which is put between the metal case 2 and the metal cover 12 and comprises a bobbin 11A of plastic disposed about the portion 2B2 and a coil 11B put around the bobbin 11A. When energized, the electric coil 11 generates a magnetic field "H" to pull and open the valve element 7 against the force of the biasing spring 9. For feeding electric power to the coil 11, connector pins 15A are provided on the case 2, as will be described in detail hereinafter.

The tubular metal cover 12 is of a magnetic metal and shaped cylindrical to constitute a magnetic path. As is seen from FIGS. 2 and 3, the tubular metal cover 12 comprises a larger diameter tubular portion 12A disposed around the electric coil 11, a smaller diameter tubular portion 12B disposed around the valve element receiving portion 2B1 of the tubular metal case 2 and an annular stepped portion 12C (see FIG. 2) extending between the larger and smaller diameter tubular portions 12A and 12B.

Figure 3:
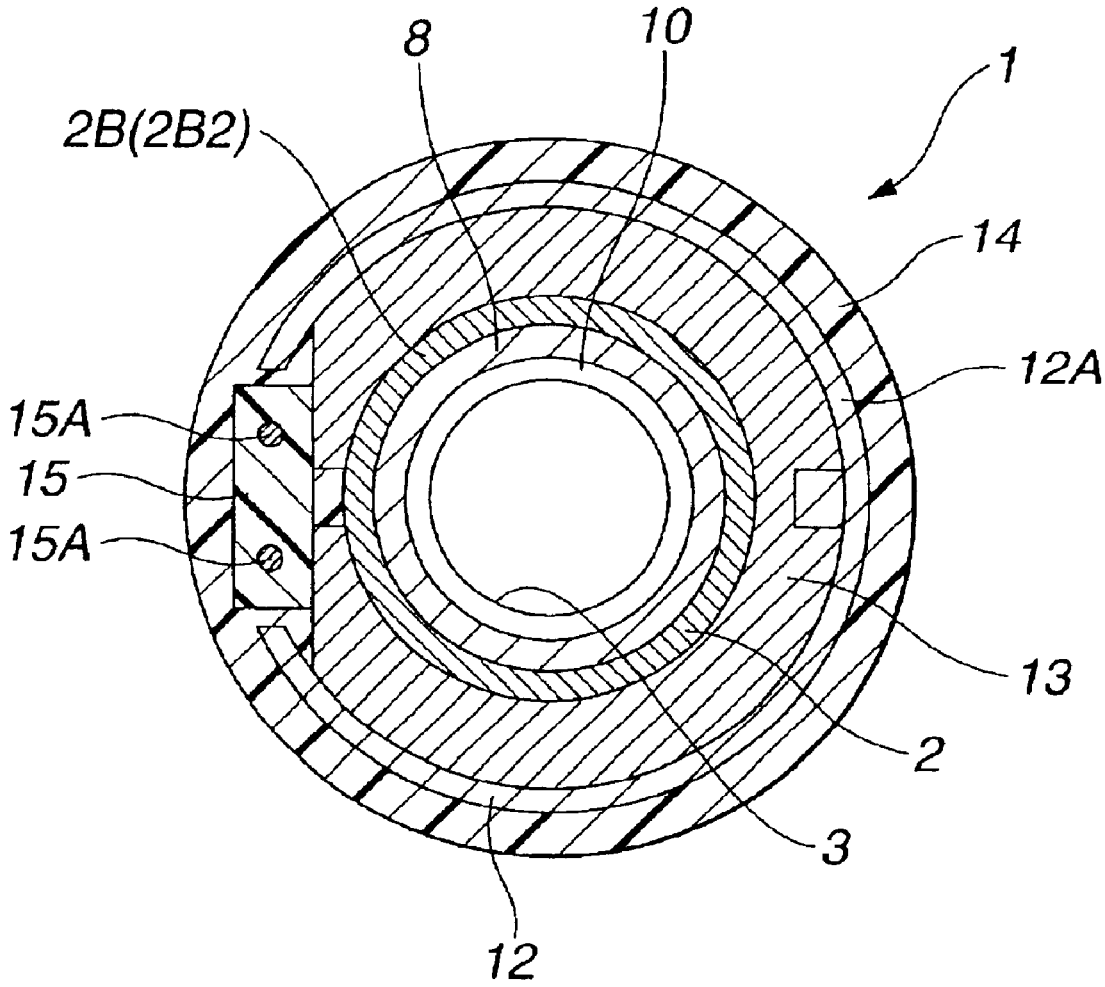
FIG. 3 is a sectional view taken along the line III—III of FIG. 1.

As is seen from FIGS. 2 and 3, within an annular space defined between the larger diameter tubular portion 12A and the smaller diameter lower portion 2A of the tubular metal case 2, there is disposed a connecting metal core 13 having a generally C-shaped cross section. The core 13 is of a magnetic metal. With the metal core 13 and the annular stepped portion 12C, the tubular metal cover 12 is magnetically connected to the metal case 2 at axially both ends of the electric coil 11.

Due to provision of the annular recess 2D of the tubular metal case 2, the valve element receiving portion 2B1 and the core tube receiving portion 2B2 are magnetically isolated from each other. Thus, upon energization of the electric coil 11, a magnetic field "H" is stably produced along a magnetic path consisting of the portions 2B1 and 2B2, the base portion 7C of the valve element 7, the core tube 8, the tubular metal cover 12 and the metal core 13, so that the core tube 8 can assuredly attract the valve element 7 to open the same.

As is seen from FIG. 1, the plastic cover 14 covers the upper portion of the tubular metal case 2. For providing this plastic cover, an injection technique is used, which will be described in detail hereinafter. The plastic cover 14 comprises an upper portion covering the larger-diameter upper portion 2C of the tubular metal case 2 and a lower portion covering the larger diameter tubular portion 12A of the tubular metal cover 12. The plastic cover 14 is integrally formed with the above-mentioned connector housing 15. Connector pins 15A are held in the connector housing 15, which lead to the electric coil 11.

Figure 6:
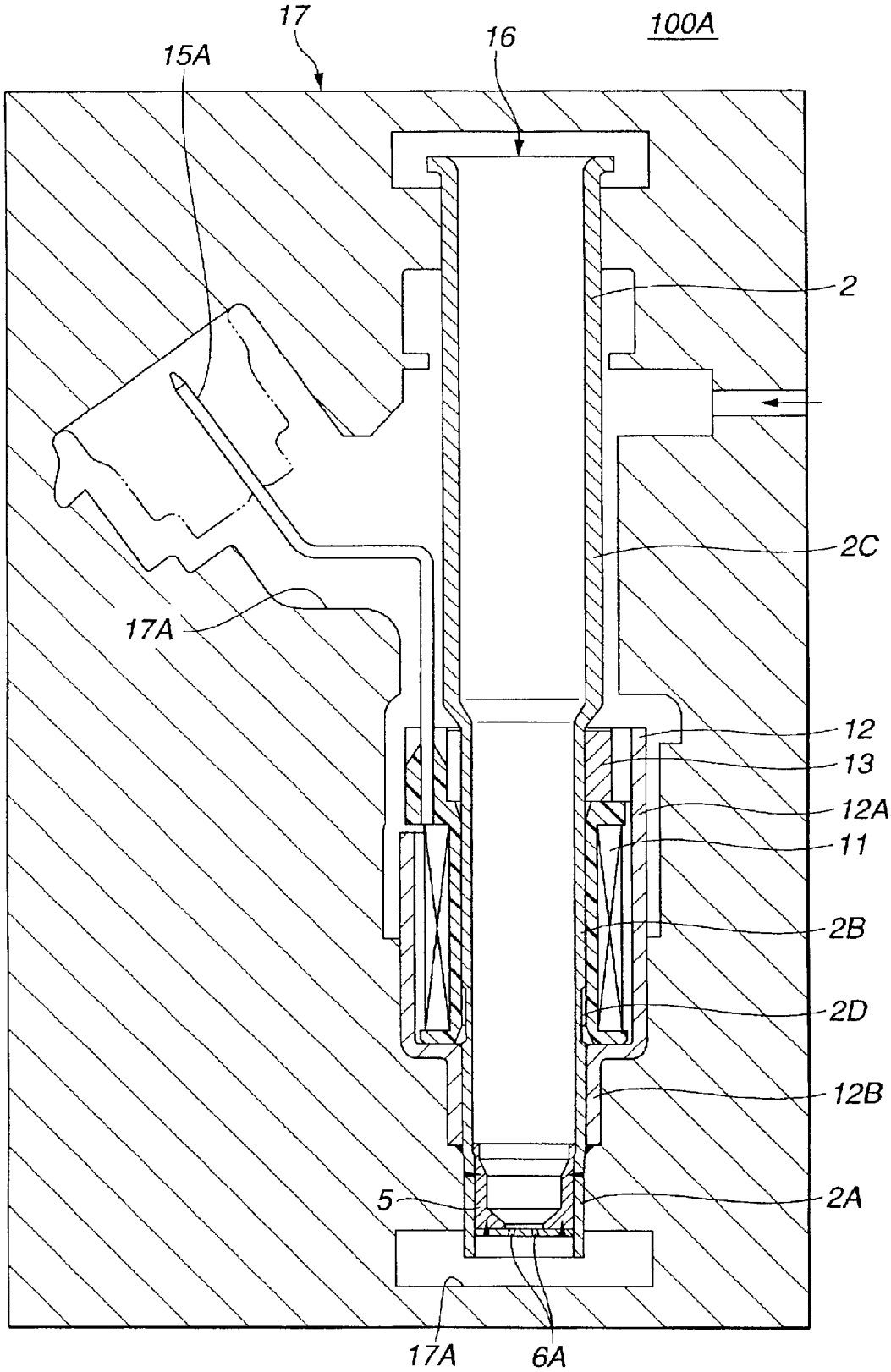
FIG. 6 is a longitudinally sectional view of the semi-finished fuel injection valve that is kept set in a mold unit for being applied with a plastic cover thereon.

When, as is seen from FIG. 6, an injection molding is practically carried out, a very high pressure of molten plastic is applied to the larger diameter upper portion 2C of the tubular metal case 2. Accordingly, in the first embodiment 100A, for bearing such high pressure, the wall thickness of only the larger diameter upper portion 2C of the case 2 is increased as compared with that of the lower and intermediate portions 2A and 2B.

In the following, operation of the fuel injection valve 100A will be described with reference to FIGS. 1 and 2.

When the electric coil 11 is energized through the connector pins 15A, a magnetic field "H" is produced as is shown in FIG. 2, causing the core tube 8 to magnetically attract the valve element 7 against the force of the biasing spring 9. With this, the valve element 7 is released from the seating surface 5B of the valve seat 5 opening the injection nozzles 6A. Upon this, a given amount of fuel is injected into, for example, a combustion chamber through the injection nozzles 6A. When energization of the electric coil 11 stops, the magnetic field "H" disappears and thus the valve element 7 is moved onto the seating surface 5B due to the force of the biasing spring 9. Upon this, fuel injection into the combustion chamber is stopped.

In the following, steps for assembling the fuel injection valve 100A will be described with reference to the drawings.

First, the tubular metal case 2 as shown in FIG. 4 is produced. For this production, various techniques, such as, deep drawing technique, cutting technique, grinding technique and the like are practically used.

Figure 5:
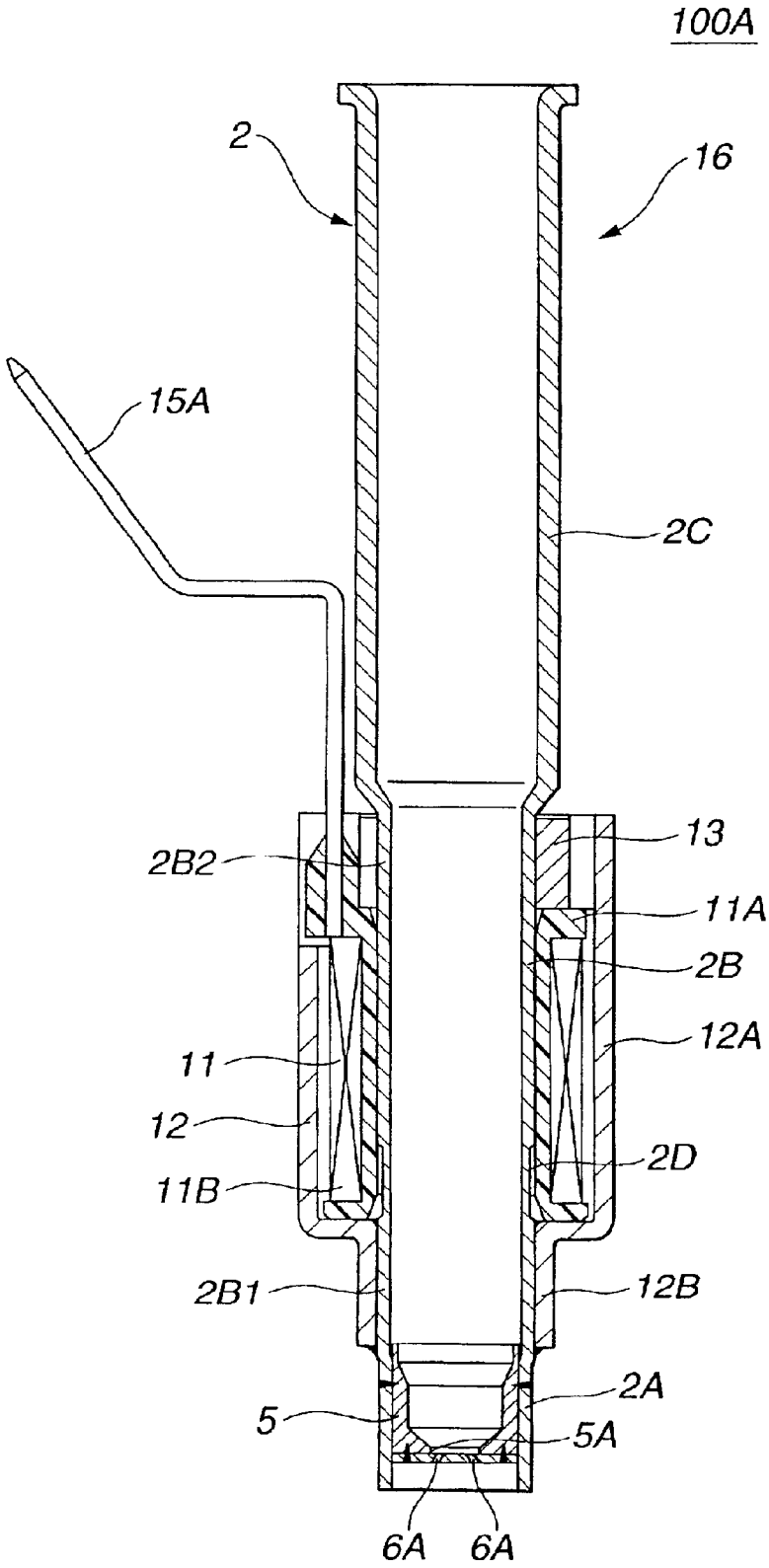
FIG. 5 is a longitudinally sectional view of a semi-finished fuel injection valve of the first embodiment.

Then, as is seen from FIG. 5, the electric coil 11, the tubular metal cover 12 and the connecting metal core 13 are put around the intermediate portion 2B of the metal case 2 together with the connector pins 15A, and the metal cover 12 is secured to the metal case 2 through welding. The valve seat 5 is put into the smaller diameter lower portion 2A of the metal case 2 and welded thereto. With these steps, a so-called semi-finished assembly 16 is produced.

Figure 7:
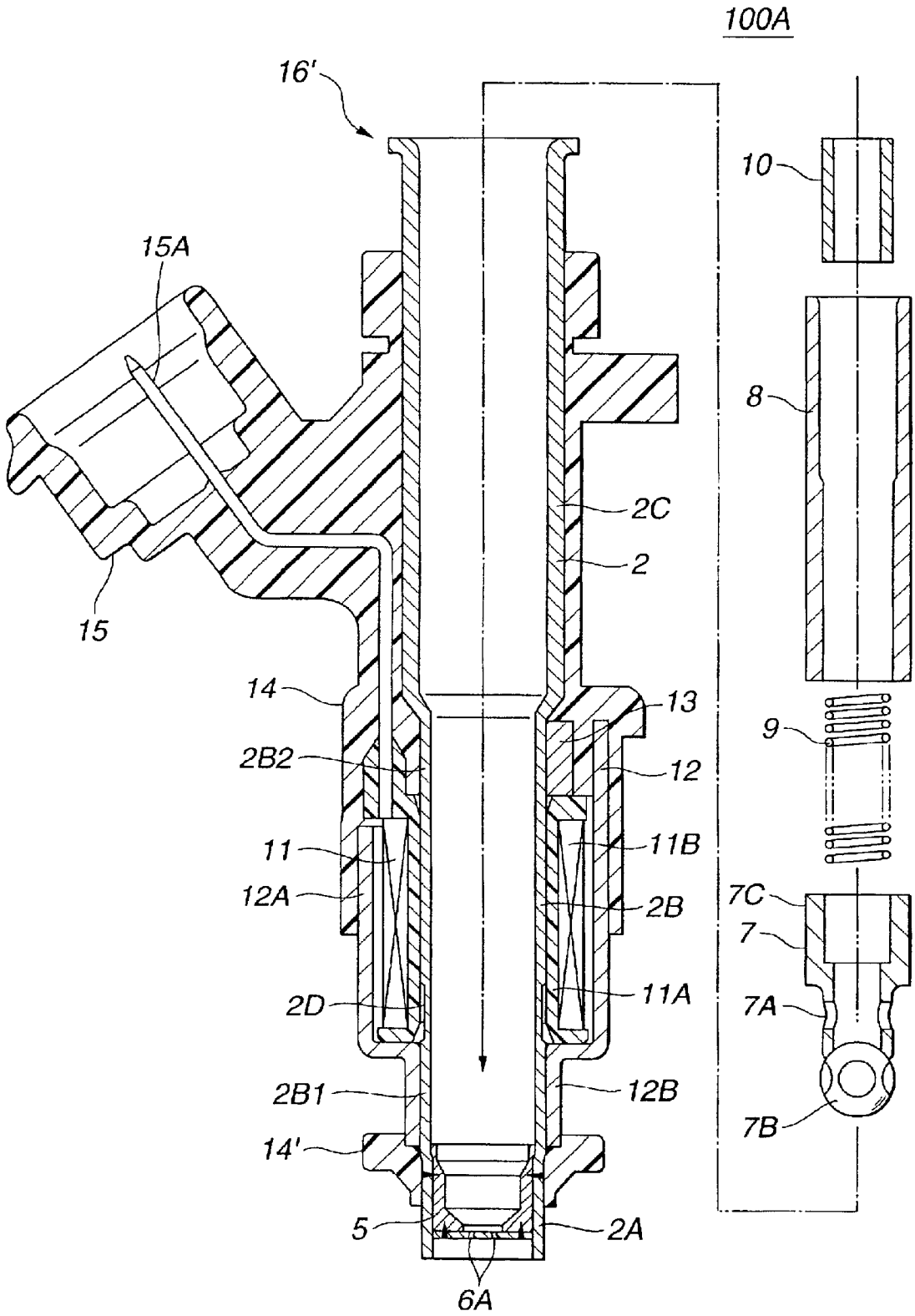
FIG. 7 is a longitudinally sectional view of the fuel injection valve of the first embodiment in a disassembled condition.

Then, the semi-finished assembly 16 is brought to an injection molding process and put into a split mold 17, as is seen from FIG. 6. As shown in the drawing, the mold 17 is constructed to have a cavity 17A whose shape is matched with the finished fuel injection valve 10A. A molten plastic is injected into the cavity 17A at a predetermined injection pressure, and after a while, that is, when the plastic becomes cured having a certain hardness, the mold 17 is dismantled to release a product 16' as shown in FIG. 7. With this injection process, the connector housing 15, the plastic cover 14 and an annular plastic ring 14' covering the lower portion 2A of the metal case 2 are integrally formed on the semi-finished assembly 16.

As has been described hereinabove, the upper portion 2C of the metal case 2 has a sufficiently thicker wall to bear the injection pressure, and thus, the upper portion 2C is suppressed from undesired deformation.

Then, as is seen from FIG. 7, remaining parts are assembled to the product 16', which are the valve element 7, the core tube 8, the biasing spring 9 and the spring holder 10.

As has been described hereinabove, in the first embodiment 100A of the present invention, the diameter of the intermediate portion 2B of the case 2 about which the electric coil 11 is disposed is reduced as compared with that of the upper portion 2C, and only the larger diameter upper portion B (see FIG. 4) or 2C of the case 2, to which a marked injection pressure is applied, has a larger wall thickness. That is, the lower and intermediate portions A (see FIG. 4) or 2A and 2B, on which the valve seat 5, the valve element 7 and the electric coil 11 are mounted, has a thinner wall thickness.

Thus, a compact and light weight fuel injection valve 100A can be easily produced. Furthermore, due to provision of the annular recess 2D on tubular metal case 2, the magnetic resistance between the two portions 2B1 and 2B2 (see FIG. 2) is increased and thus a magnetic isolation between the two portions is improved.

Figure 8:
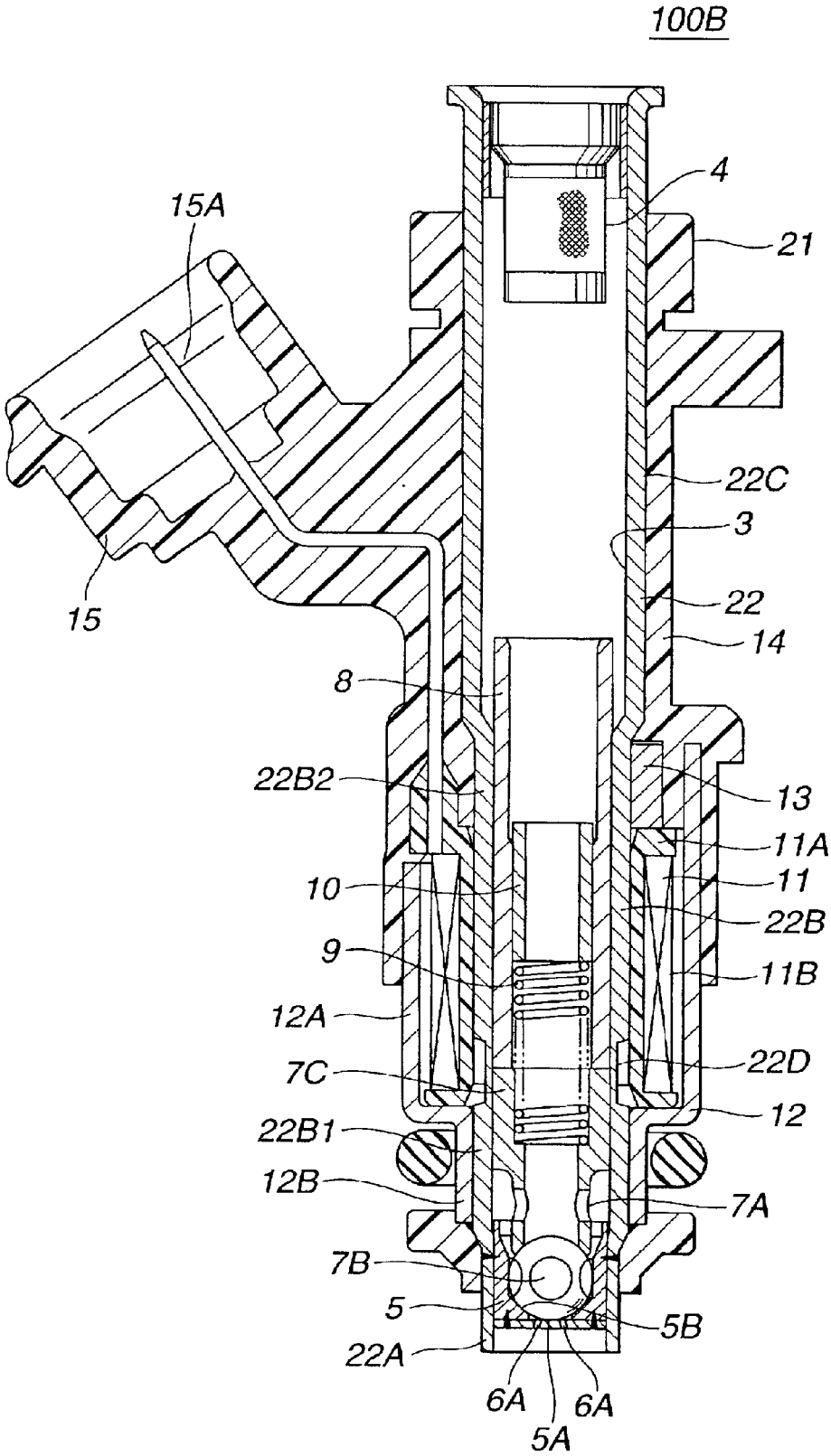
FIG. 8 is a view similar to FIG. 1, but showing a fuel injection valve of a second embodiment of the present invention.
Figure 9:
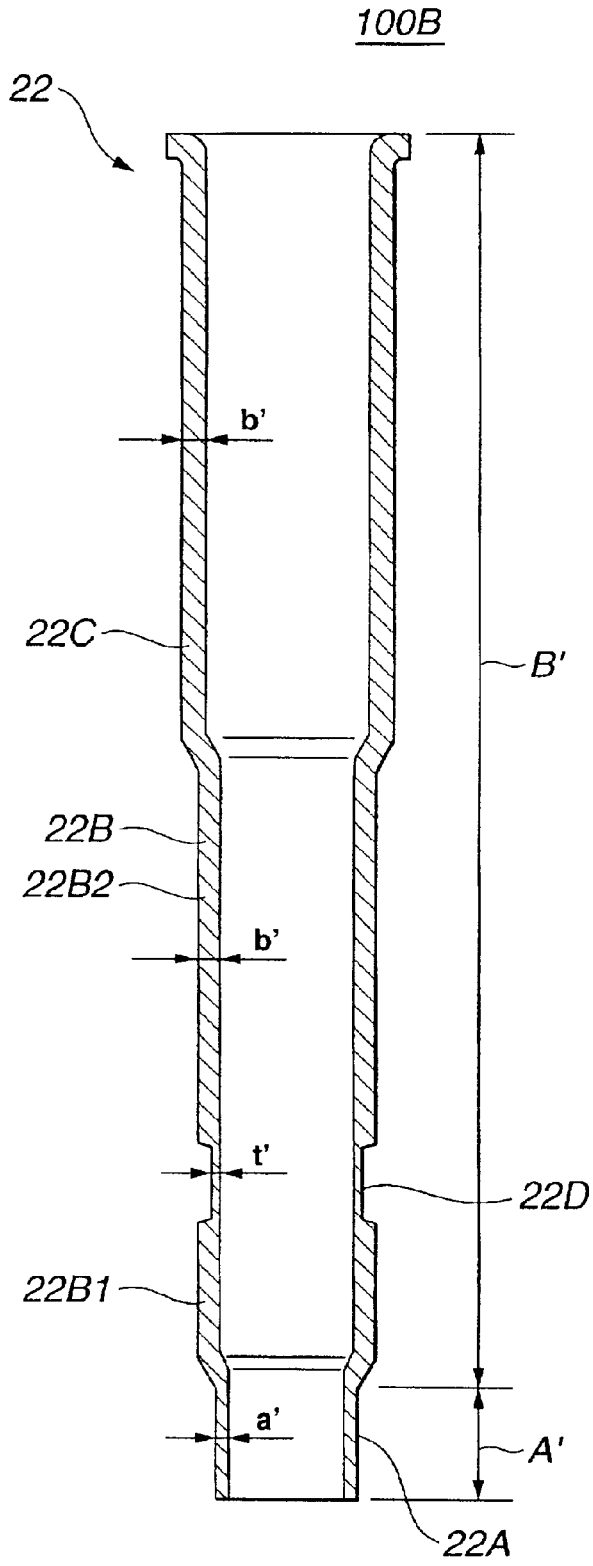
FIG. 9 is a longitudinally sectional view of a tubular metal case employed in the fuel injection valve of the second embodiment.

Referring to FIGS. 8 and 9, especially FIG. 8, there is shown a fuel injection valve of a second embodiment of the present invention, which is generally designated by numeral 100B.

Since the fuel injection valve 100B of the second embodiment is similar to the above-mentioned valve 100A of the first embodiment, only parts or portions which are different from those of the first embodiment 100A will be described in the following.

That is, as is seen from FIG. 9, a tubular metal case 22 employed in the second embodiment 100B is different from that 2 of the first embodiment 100A.

As will be understood when comparing FIGS. 9 and 4, the tubular metal case 22 of the second embodiment 100B comprises a smaller diameter lower portion 22A to which the valve seat 5 is to be fixed, an intermediate portion 22B around which the electric coil 11 is to be disposed, and a larger diameter upper portion 22C around which the major portion of the plastic cover 14 is to be disposed.

As shown in FIG. 9, in the second embodiment 100B, the wall thickness of the intermediate portion 22B is equal to that of the upper portion 22C. The intermediate portion 22B is formed with an annular recess 22D whose bottom wall has a thickness "t'". Due to provision of the annular recess 22D, the intermediate portion 22B is divided into a valve element receiving portion 22B1 and a core tube receiving portion 22B2.

The lower portion 22A of the tubular-metal case 22 has a wall thickness "a'" of about 0.1 mm to 0.9 mm, preferably about 0.2 mm to 0.5 mm. The intermediate portion 22B and the upper portion 22C of the case 22 have a wall thickness "b'" that is greater than that "a'" of the lower portion 22A by at least 0.1 mm. That is, the tubular metal case 22 consists of two portions, one being a thinner wall portion "A'" including the lower portion 22A, and the other being a thicker wall portion "B'" including the intermediate and upper portions 22B and 22C.

Also, in this second embodiment 100B, the diameter of the intermediate portion 22B of the case 22 about which the electric coil 11 is to be disposed is reduced as compared with that of the upper portion 22C. Thus, a compact and light weight fuel injection valve 100B can be easily produced. Due to increased wall thickness of the intermediate portion 22B, the tubular metal case 22 is much assuredly suppressed from an undesirable deformation thereof, which would appear upon the injection molding of the valve casing unit 21.

Figure 10:
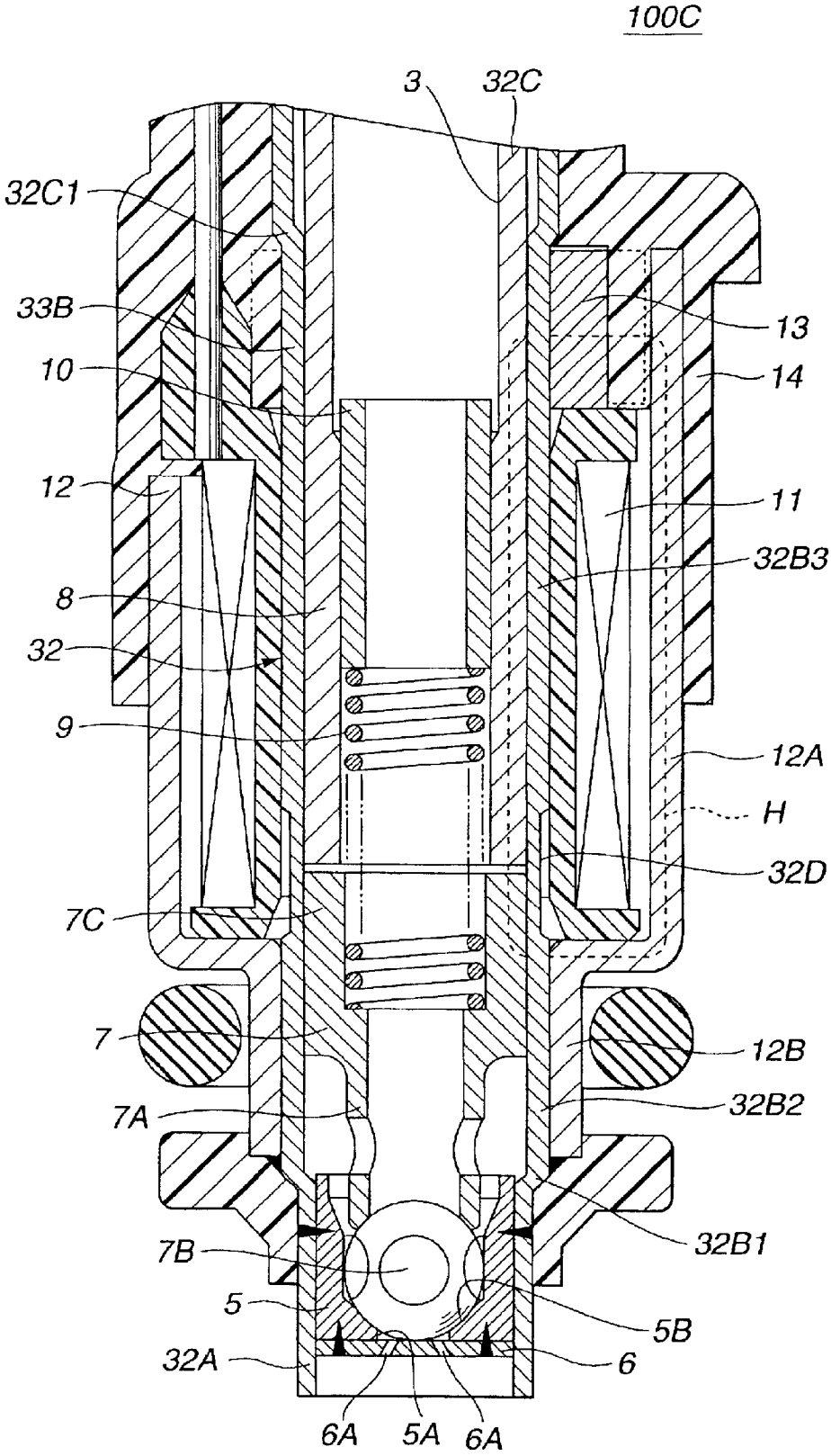
FIG. 10 is a view similar to FIG. 2, but showing a fuel injection valve of a third embodiment of the present invention.

Referring to FIGS. 10 to 15, particularly FIG. 10, there is shown a fuel injection valve of a third embodiment of the present invention, which is generally designated by numeral 100C.

Figure 14:
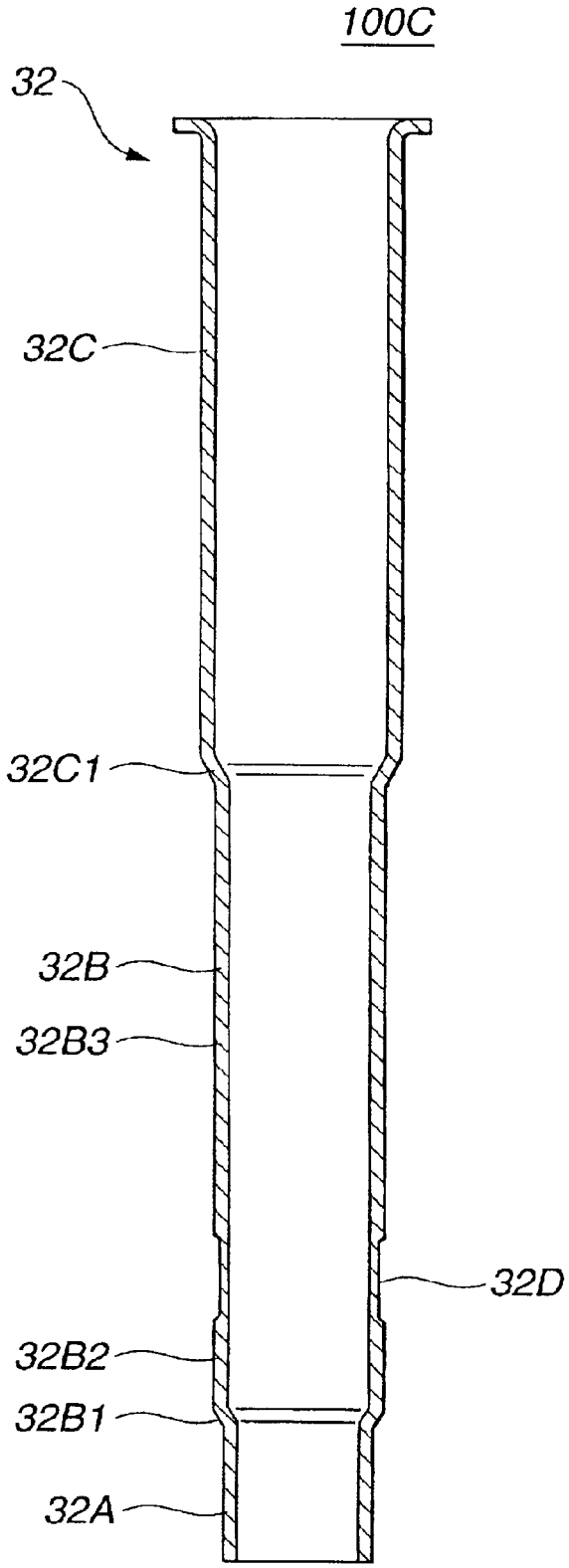
FIG. 14 is a longitudinally sectional view of the tubular metal case produced by being applied with a third deep drawing process after the first and second deep drawing processes.

In the third embodiment 100C, a tubular metal case 32 as shown in FIG. 14 is used, which is constructed of a ferritic stainless steel containing Titanium (Ti), as will be described in detail hereinafter. As shown in the drawing, in this third embodiment 100C, the tubular metal case 32 has an even wall thickness "a" throughout the entire length thereof. Preferably, the thickness "a" is about 0.1 mm to about 0.9 mm.

That is, as is seen from FIG. 10, a smaller diameter lower portion 32A to which the valve seat 5 is to be fixed, an intermediate portion 32B which has the electric coil 11 to be disposed thereon, and a larger diameter upper portion 32C which has the major portion of the plastic cover 14 to be disposed thereon have the even wall thickness therethroughout. As is seen from FIG. 14, a stepped portion defined between the intermediate and upper portions 32B and 32C is denoted by 32C1, and a stepped portion defined between the lower and intermediate portions 32A and 32B is denoted by 32B1. An annular recess formed on the intermediate portion 32B is denoted by 32D. Due to provision of the annular recess 32D, the intermediate portion 32B is divided into a valve element receiving portion 32B2 and a core tube receiving portion 32B3.

In the following, the material of the tubular metal case 32 will be described in detail.

That is, the metal case 32 is constructed of a ferritic stainless steel containing about 0.01 to about 0.12 (preferably, 0.01 to 0.05) wt. % of Carbon, which further contains over 16 wt. % of Chromium (Cr), over 0.08 wt. % of Nickel (Ni) and about 0.2 to 0.6 wt. % of Titanium (Ti). Percentage content of Titanium (Ti) is greater than that of Carbon (C).

For finding out the composition of material appropriate to the tubular metal case 32, an examination was carried out by the applicants, which will be described in the following.

Table-1 shows three Examples that were used as the material of the metal case 32. For comparison, one Reference examined is also shown.

TABLE 1

| | Percentage Contents (wt. %) | | | |
|---|---|---|---|---|
| Elements | Example-1 SUS430M2 | Exampe-2 SUS430M3 | Example-3 SUS430WD | Reference SUS430 |
| Cr | 16.46 | 17.3 | 16.31 | 16–18 |
| C | 0.03 | 0.01 | 0.01 | below 0.12 |
| Si | 0.39 | 0.45 | 0.13 | below 0.75 |
| Mn | 0.28 | 0.22 | 1.43 | below 1.00 |
| P | 0.022 | 0.027 | 0.03 | below 0.04 |
| S | 0.006 | 0.007 | 0.005 | below 0.03 |
| Ni | 0.12 | 0.17 | 0.08 | — |
| Mo | — | 0.4 | — | — |
| N | 0.009 | — | — | — |
| Ti | 0.27 | 0.55 | 0.22 | — |
| Fe | Residual | Residual | Residual | Residual |
| Total | 100 | 100 | 100 | 100 |

Table-2 shows the performance of the three Examples and the Reference.

TABLE 2

| | Example-1 SUS430M2 | Example-2 SUS430M3 | Example-3 SUS430WD | Reference SUS430 |
|---|---|---|---|---|
| Elongation rate (%) | 32 | 32 | 34 | over 22 |
| Hardness (Hv) | 154 | 163 | 142 | below 200 |

The tubular metal cases subjected to the examination were produced in the following manner, which will be described with reference to FIGS. 11, 12 and 13.

Figure 11:
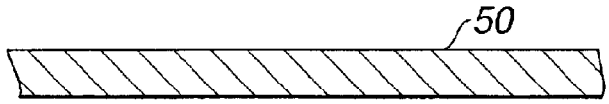
FIG. 11 is a sectional view of a metal plate that is used for producing a tubular metal case employed-in the third embodiment.

As is seen from FIG. 11, four metal plates 50 of the above-mentioned ferritic stainless steel were prepared, which were Example-1, Example-2, Example-3 and Reference.

Each metal plate 50 was then subjected to a three-step deep drawing process which was carried out by three mold units in order.

Figure 12:
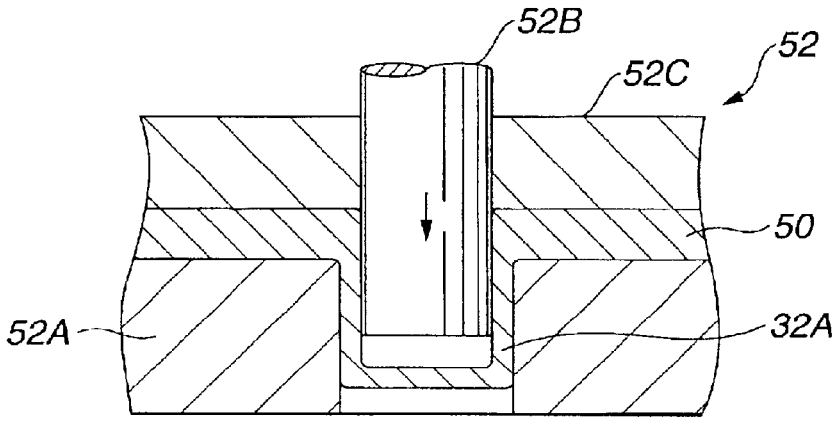
FIG. 12 is a sectional view showing a condition wherein the metal plate is under a first deep drawing process.
Figure 13:
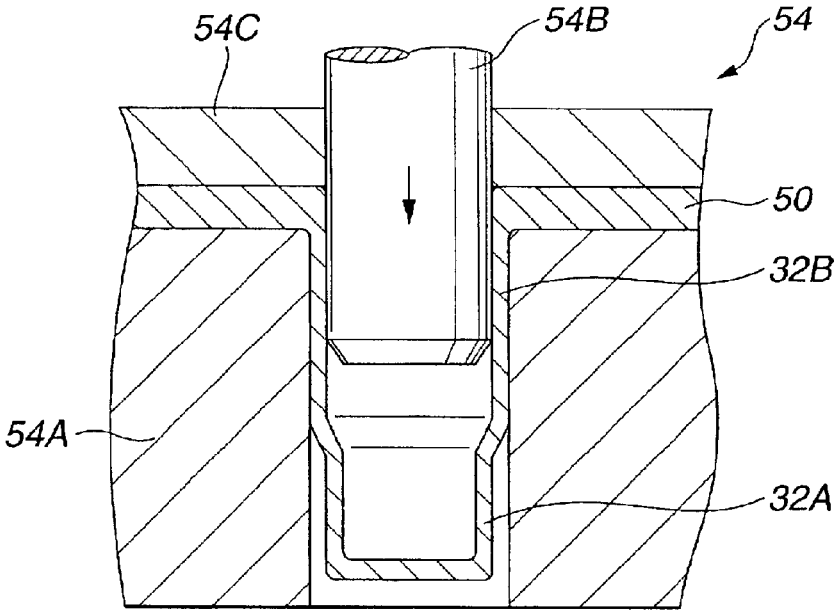
FIG. 13 is a view similar to FIG. 12, but showing a condition wherein the metal plate is under a second deep drawing process.

First, as is seen from FIG. 12, the metal plate 50 was set in a first mold unit 52 which comprises a female die 52A, a male die 52B and a holder 52C. By pushing a given portion of the metal plate 50 into a bore of the female die 52A by the male die 52B, the smaller diameter lower portion 32A of the metal case 32 was drawn or produced. Then, as is seen from FIG. 12, the metal plate 50 was set in a second mold unit 54 which comprises a female die 54A, a male die 54B and a holder 54C. The drawn part 32A of the metal plate 50 was put in a bore of the female die 54A. The bore of the female die 54A was somewhat larger than that of the female die 52A of the first die unit 52. Then, the male die 54B was pushed into the drawn part 32A of the metal plate 50. With this, the intermediate portion 32B of the metal case 32, which extends from the lower portion 32A, was drawn or produced. Then, although not shown in the drawings, the metal plate 50 was set in a third die unit and subjected to a similar drawing process. The bore of the female die of the third mold unit was somewhat larger than that of the female die 54A of the second mold unit 54. With the process of the third mold unit, the larger diameter upper portion 32C of the metal case 32 was drawn or produced. Then, the deeply drawn tubular part consisting of the three portions 32A, 32B and 32C was cut away from a remaining part of the metal plate 50. Then, the deeply drawn tubular part thus cut was subjected to cutting and shaving processes to produce a finished product, viz., the tubular metal case 32 as shown in FIG. 14.

Then, the four tubular metal cases 32 thus produced were subjected to a visual inspection. No damage was found in any of the Examples-1, 2 and 3, except the Reference.

Figure 15:
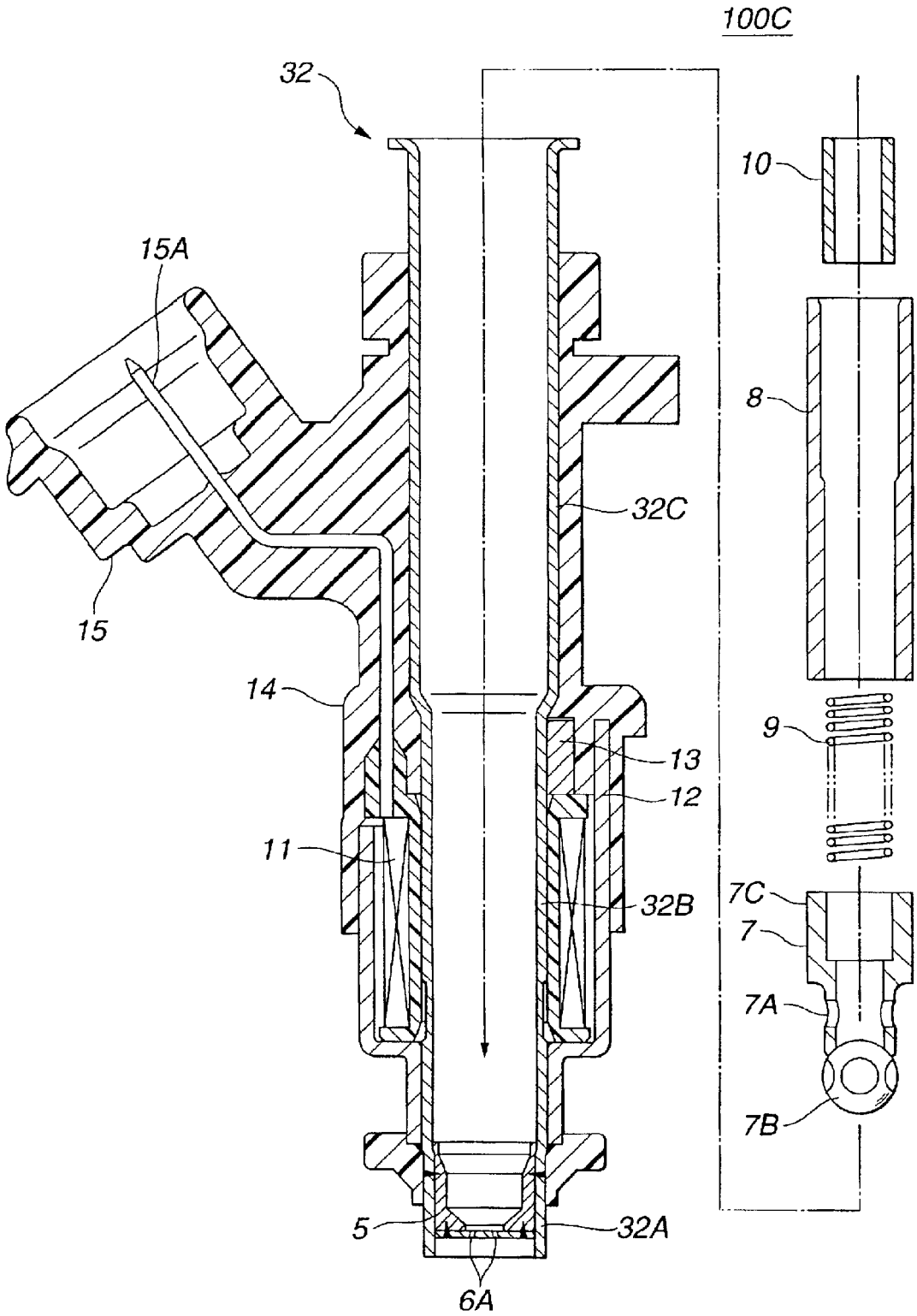
FIG. 15 is a longitudinally sectional view of the fuel injection valve of the third embodiment in a disassembled condition.

As is seen from FIG. 15, in an assembling process, the tubular metal case 32 is applied and equipped with the electric coil 11, the metal cover 12, the connecting metal core 13, the plastic cover 14 including the connector housing 15, the valve seat 5, the valve element 7, the core tube 8, the biasing spring 9 and the spring holder 10 in the same manner as is described hereinabove.

In the fuel injection valve 100C of the third embodiment, the tubular metal case 32 is constructed of a ferritic stainless steel containing Titanium (Ti). Thus, mechanical strength, corrosion resistance and productivity of the metal case 32 increased or improved. It was found that when Titanium (Ti) occupied 0.2 to 0.6 wt. % in the ferritic stainless steel and exceeded the content of Carbon (C), the deep drawing for the metal case 32 was much easily carried out. It was further found that when Carbon (C) occupied 0.01 to 0.12 wt. %, the corrosion resistance of the metal case 32 was quite improved. Furthermore, it was found that addition of over 0.3 wt. % of molybdenum (Mo) further improved the corrosion resistance of the metal case 32.

Figure 16:
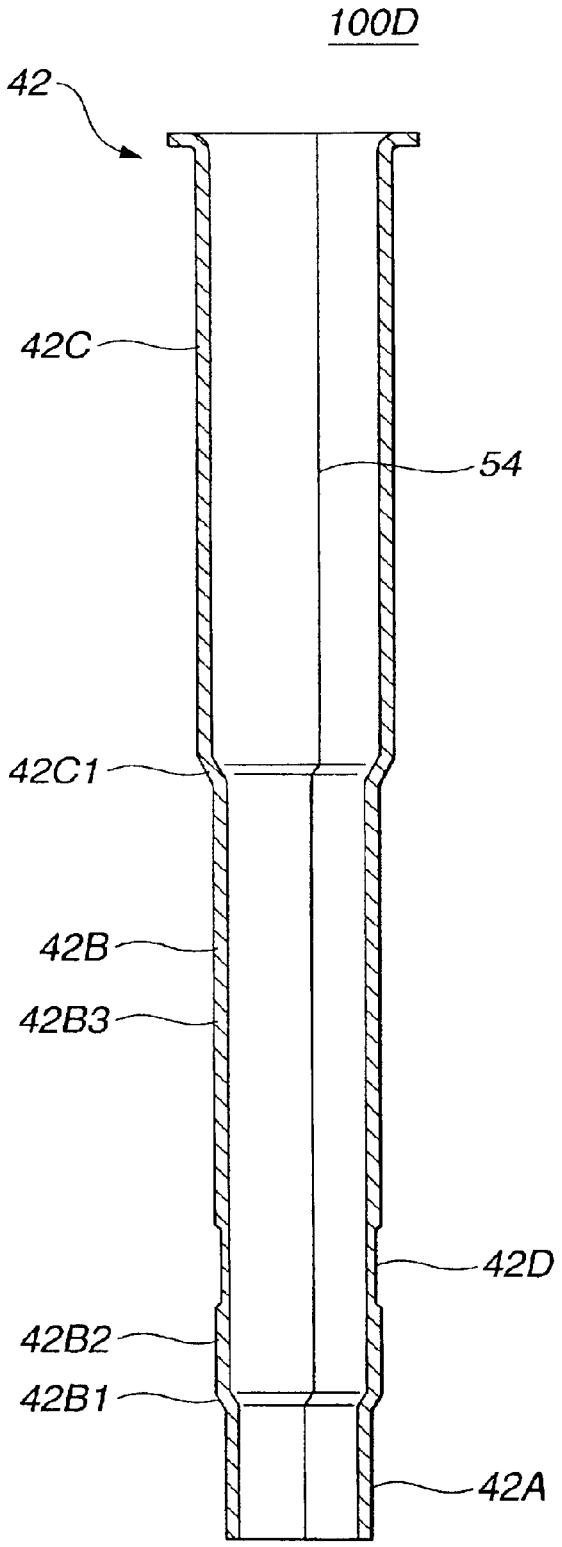
FIG. 16 is a view similar to FIG. 4, but showing a tubular metal case employed in a fuel injection valve of a fourth embodiment of the present invention.
Figure 17:
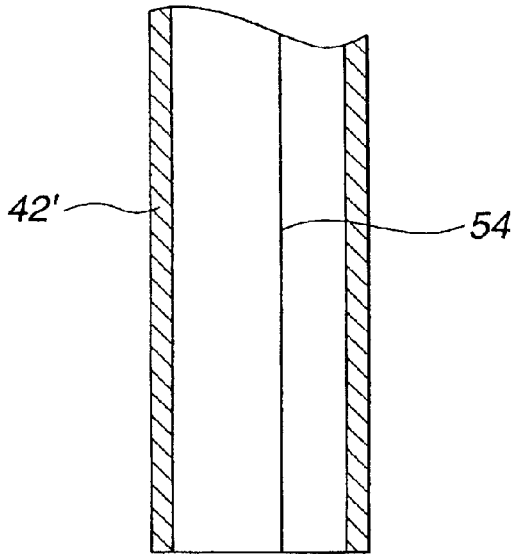
FIG. 17 is a longitudinally sectional view of a metal tube used for producing the tubular metal case employed in the fourth embodiment of the present invention.
Figure 18:
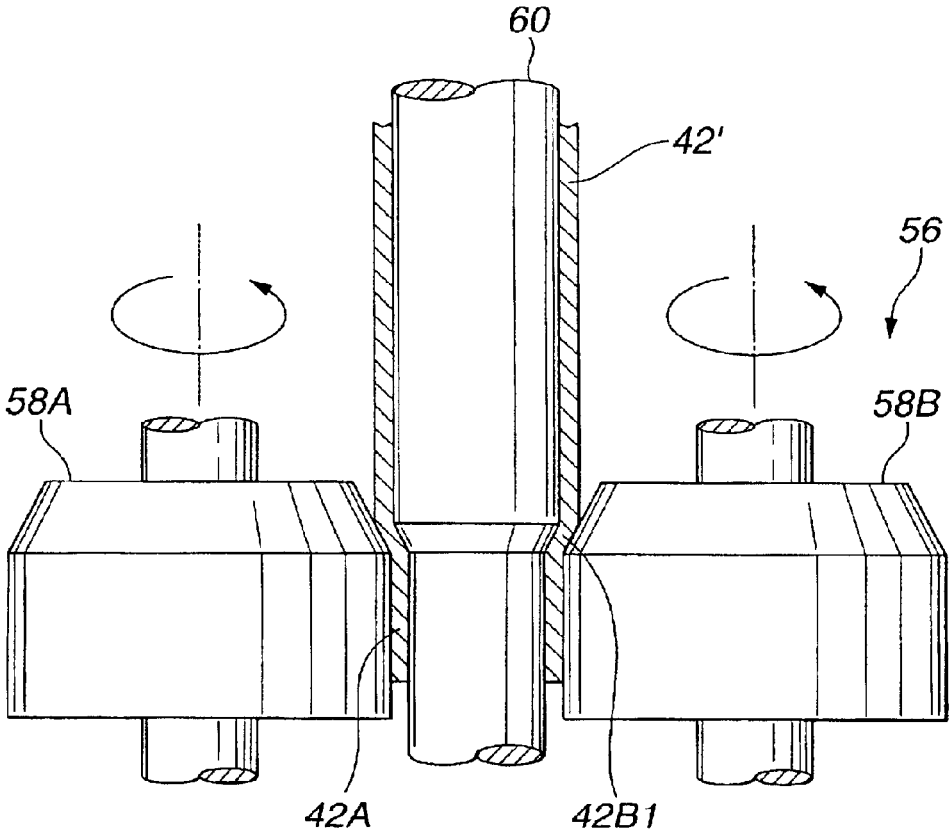
FIG. 18 is a schematic drawing showing a drawing process applied to the metal tube.

Referring to FIGS. 16 to 18, particularly FIG. 16, there is shown a tubular metal case 42 which is employed in a fuel injection valve 100D of a fourth embodiment of the present invention.

In this fourth embodiment 100D, the tubular metal case 42 is produced by rolling a metal plate 50 (see FIG. 11) to form a pipe, welding circumferentially opposed edges of the pipe and drawing given portions of the pipe to form stepped portions. A line indicated by numeral 54 in FIG. 16 is the circumferentially opposed edges to which welding has been applied.

That is, by taking the following steps, the metal plate 50 is shaped into a finished product, that is, the tubular metal case 42.

As is seen from FIG. 17, by using a rolling machine, the metal plate 50 is shaped into a pipe 42', then by using a seam welding machine, circumferentially opposed edges 54 are welded. Then, as is seen from FIG. 18, the pipe 42' is applied to a drawing machine 56 which comprises a pair of rollers 58A and 58B and a stepped male die 60. That is, the mail die 60 is put into the pipe 42' and the pipe 42' is brought into a space defined between the paired rollers 58A and 58B. Then, the rollers 58A and 58B are rotated and moved toward each other narrowing the space. With this, a stepped portion 42B1 is formed on-the pipe 42' near the smaller diameter lower portion 42A. By taking a similar process, another stepped portion 42C1 (see FIG. 16) is formed on the pipe 42'.

In the above-mentioned third and fourth embodiments 100C and 100D, a ferritic stainless steel containing Titanium (Ti) is used as the material of the tubular metal cases 32 and 42. However, if desired, over 0.3 wt. % of copper (Cu), over 0.3 wt. % of niobium (Nb) or both of them may be added to the material for much increasing or improving mechanical strength and corrosion resistance of the case 32 or 42.

The entire contents of Japanese Patent Applications 2001-163414 filed May 30, 2001 and 2001-165518 filed May 31, 2001 are incorporated herein by reference.

Although the invention has been described above with reference to the embodiments of the invention, the invention is not limited to such embodiments as described above. Various modifications and variations of such embodiments may be carried out by those skilled in the art, in light of the above description.

What is claimed is:

1. A fuel injection valve comprising:

a tubular metal case constructed of a magnetic material in and through which a fuel is to flow, said tubular metal case having one open end;

a valve seat tightly received in said open end of said tubular metal case, said valve seat having a fuel outlet formed therein;

a valve element axially movably received in said tubular metal case, said valve element being movable between a closed position wherein a valve body of the element closes said fuel outlet and an open position wherein said valve body opens said fuel outlet; and an electromagnetic actuator disposed about said tubular metal case to actuate said valve element to move between said closed and open positions, wherein said tubular metal case is constructed of a ferritic stainless steel containing Titanium and in which said ferritic stainless steel contains approximately 0.2 to 0.6 wt. % of Titanium.

2. A fuel injection valve as claimed in claim 1, in which said tubular metal case is constructed to have stepped portions thereon.

3. A fuel injection valve as claimed in claim 2, in which said tubular metal case is produced by applying a metal plate to a deep drawing process.

4. A fuel injection valve comprising:

a tubular metal case constructed of a magnetic material in and through which a fuel is to flow, said tubular metal case having one open end;

a valve seat tightly received in said open end of said tubular metal case, said valve seat having a fuel outlet formed therein;

a valve element axially movably received in said tubular metal case, said valve element being movable between a closed position wherein a valve body of the element closes said fuel outlet and an open position wherein said valve body opens said fuel outlet; and an electromagnetic actuator disposed about said tubular metal case to actuate said valve element to move between said closed and open positions, wherein said tubular metal case is constructed of a ferritic stainless steel containing Titanium and in which said ferritic stainless steel contains approximately 0.01 to 0.12 wt. % of carbon which is less than that of said Titanium.

5. A fuel injection valve as claimed in claim 4, in which said tubular metal case is constructed to have stepped portions thereon.

6. A fuel injection valve as claimed in claim 5, in which said tubular metal case is produced by applying a metal plate to a deep drawing process.

7. A fuel injection valve comprising:

a tubular metal case constructed of a magnetic material in and through which a fuel is to flow, said tubular metal case having one open end;

a valve seat tightly received in said open end of said tubular metal case, said valve seat having a fuel outlet formed therein;

a valve element axially movably received in said tubular metal case, said valve element being movable between a closed position wherein a valve body of the element closes said fuel outlet and an open position wherein said valve body opens said fuel outlet; and an electromagnetic actuator disposed about said tubular metal case to actuate said valve element to move between said closed and open positions, wherein said tubular metal case is constructed of a ferritic stainless steel containing Titanium, further comprising:

a core tube of magnetic metal, said core tube being tightly received in said tubular metal case in a manner to define a given clearance between the core tube and said valve element; and an annular recess formed on a cylindrical outer surface of said tubular metal case in a manner to enclose said given clearance, said annular recess functioning to increase a magnetic resistance of said tubular metal case when exposed to a magnetic field.

8. A fuel injection valve comprising:

a tubular metal case constructed of a magnetic material in and through which a fuel is to flow, said tubular metal case having one open end;

a valve seat tightly received in said open end of said tubular metal case, said valve seat having a fuel outlet formed therein;

a valve element axially movably received in said tubular metal case, said valve element being movable between a closed position wherein a valve body of the element closes said fuel outlet and an open position wherein said valve body opens said fuel outlet; and an electromagnetic actuator disposed about said tubular metal case to actuate said valve element to move between said closed and open positions, wherein said tubular metal case is constructed of a ferritic stainless steel containing Titanium, in which said tubular metal case comprises:

a first portion which one end;

a second portion with the other end; and a third portion which extends between said first and second portions, wherein said first portion has a wall thickness which ranges from approximately 0.1 mm to 0.9 mm, said second portion has a wall thickness which is greater than that of said first portion by at least approximately 0.1 mm, and said third portion has the same wall thickness as one of said first and second portions.

9. A fuel injection valve comprising:

a tubular metal case constructed of a magnetic material in and through which a fuel is to flow, said tubular metal case including a first portion with one end, a second portion with the other end and a third portion extending between said first and second portions;

a valve seat tightly received in said first portion of the metal case, said valve seat having a fuel outlet formed therein;

a valve element axially movably received in said third portion of the metal case, said valve element being movable between a closed position wherein a valve body of the element closes said fuel outlet and an open position wherein said valve body opens said fuel outlet;

an electromagnetic actuator disposed on and about said third portion of the metal case to actuate said valve element to move between said closed and open positions;

a plastic cover applied mainly onto said second portion of the metal case through an injection molding, wherein said first portion of the metal case has a wall thickness which ranges from approximately 0.1 mm to 0.9 mm, said second portion of the metal case has a wall thickness which is greater than that of said first portion by at least approximately 0.1 mm, and said third portion of the metal case has the same wall thickness as one of said first and second portions.

10. A fuel injection valve as claimed in claim 9, in which said third portion of said metal case has the same wall thickness as said first portion.

11. A fuel injection valve as claimed in claim 9, in which said third portion of said metal case has the same wall thickness as said second portion.

12. A fuel injection valve as claimed in claim 9, further comprising:

a core tube of magnetic metal, said core tube being tightly received in said third portion of said tubular metal case in a manner to define a given clearance between the core tube and said valve element; and a biasing spring compressed between said core tube and said valve element to bias said valve element toward the closed position.

13. A fuel injection valve as claimed in claim 12, in which said electromagnetic actuator comprises:

a plastic bobbin disposed about said third portion of the tubular metal case;

an electric coil disposed on and supported by said plastic bobbin; and a tubular metal cover of magnetic metal, said tubular metal cover being disposed around said electric coil.

14. A fuel injection valve as claimed in claim 12, in which said second portion of the tubular metal case is formed thereabout an annular recess, said annular recess being positioned to surround said given clearance between the core tube and said valve element, said annular recess functioning to increase a magnetic resistance of said tubular metal case when exposed to a magnetic field.

15. A fuel injection valve as claimed in claim 9, in which said plastic cover is integrally formed with a connector housing and in which connector pins are held by said connector housing, said connector pins being led to said electromagnetic actuator.

16. A fuel injection valve as claimed in claim 9, in which said tubular metal case is constructed of a ferritic stainless steel containing Titanium.

* * * * *